US009435158B2

(12) United States Patent
Johnson

(10) Patent No.: US 9,435,158 B2
(45) Date of Patent: Sep. 6, 2016

(54) USE OF TUNGSTEN CARBIDE TUBE ROD TO HARD-FACE PDC MATRIX

(71) Applicant: Varel International Ind., L.P., Carrollton, TX (US)

(72) Inventor: Charles Daniel Johnson, Porter, TX (US)

(73) Assignee: VAREL INTERNATIONAL IND., L.P, Carrollton, TX (US)

( * ) Notice: Subject to any disclaimer, the term of this patent is extended or adjusted under 35 U.S.C. 154(b) by 560 days.

(21) Appl. No.: 13/649,830

(22) Filed: Oct. 11, 2012

(65) Prior Publication Data

US 2013/0092453 A1 Apr. 18, 2013

Related U.S. Application Data

(60) Provisional application No. 61/547,328, filed on Oct. 14, 2011.

(51) Int. Cl.

| | |
|---|---|
| ***E21B 10/54*** | (2006.01) |
| ***E21B 10/42*** | (2006.01) |
| ***E21B 17/10*** | (2006.01) |
| ***B22F 7/06*** | (2006.01) |
| ***C22C 29/06*** | (2006.01) |
| ***C22C 29/08*** | (2006.01) |
| ***C22C 1/05*** | (2006.01) |
| ***C22C 1/10*** | (2006.01) |
| ***C22C 29/12*** | (2006.01) |
| ***C22C 29/16*** | (2006.01) |

(52) U.S. Cl.

CPC ..... *E21B 10/54* (2013.01); *B22F 7/06* (2013.01); *C22C 1/051* (2013.01); *C22C 1/1036* (2013.01); *C22C 29/06* (2013.01); *C22C 29/08* (2013.01); *C22C 29/12* (2013.01); *C22C 29/16* (2013.01); *E21B 10/42* (2013.01); *E21B 17/1085* (2013.01); *C22C 2204/00* (2013.01)

(58) Field of Classification Search

CPC ..... E21B 10/00–10/66

See application file for complete search history.

(56) References Cited

U.S. PATENT DOCUMENTS

| | | | | | |
|---|---|---|---|---|---|
| 3,471,921 | A | * | 10/1969 | Feenstra | 228/124.1 |
| 3,757,878 | A | * | 9/1973 | Wilder et al. | 175/434 |
| 4,277,108 | A | * | 7/1981 | Wallace | 175/325.1 |
| 4,460,053 | A | * | 7/1984 | Jurgens et al. | 175/430 |
| 4,556,607 | A | | 12/1985 | Sastri | |

(Continued)

OTHER PUBLICATIONS

Dictionary definition of "formed", accessed Mar. 21, 2016 via thefreedictionary.com.*

(Continued)

*Primary Examiner* — Blake Michener

(57) ABSTRACT

A hardfaced infiltrated matrix downhole tool and a method for hardfacing such items. The hardfaced infiltrated matrix downhole tool includes a body, an intermediate base coat coupled to at least a portion of the surface of the body, and a hardfacing material coupled to at least a portion of the intermediate base coat. The body is composed of at least a carbide material and an infiltrating binder material. The intermediate base coat bonds to the surface of the body and to the hardfacing material. The method includes obtaining an infiltrated matrix downhole tool, applying and bonding the intermediate base coat to at least a portion of the surface of the infiltrated matrix downhole tool, and applying and bonding the hardfacing material to at least a portion of the intermediate base coat.

17 Claims, 6 Drawing Sheets

(56) References Cited

U.S. PATENT DOCUMENTS

| | | | | |
|---|---|---|---|---|
| 4,610,320 | A * | 9/1986 | Beakley | 175/425 |
| 4,814,234 | A * | 3/1989 | Bird | 428/564 |
| 4,884,477 | A * | 12/1989 | Smith et al. | 76/108.2 |
| 5,373,907 | A * | 12/1994 | Weaver | 175/426 |
| 5,663,512 | A * | 9/1997 | Schader et al. | 75/239 |
| 5,755,299 | A * | 5/1998 | Langford et al. | 175/375 |
| 5,967,248 | A * | 10/1999 | Drake et al. | 175/425 |
| 6,360,832 | B1 * | 3/2002 | Overstreet et al. | 175/374 |
| 6,651,756 | B1 * | 11/2003 | Costo et al. | 175/374 |
| 7,240,746 | B2 * | 7/2007 | Overstreet et al. | 175/374 |
| 7,484,577 | B2 * | 2/2009 | Overstreet et al. | 175/374 |
| 7,571,782 | B2 * | 8/2009 | Hall et al. | 175/432 |
| 8,776,341 | B2 * | 7/2014 | Overstreet et al. | 29/402.18 |
| 2003/0079565 | A1 * | 5/2003 | Liang et al. | 75/240 |
| 2004/0245022 | A1 * | 12/2004 | Izaguirre et al. | 175/374 |
| 2004/0245024 | A1 * | 12/2004 | Kembaiyan | 175/425 |
| 2006/0032677 | A1 * | 2/2006 | Azar et al. | 175/430 |
| 2006/0185908 | A1 | 8/2006 | Kembaiyan et al. | |
| 2006/0231293 | A1 * | 10/2006 | Ladi et al. | 175/374 |
| 2008/0053709 | A1 * | 3/2008 | Lockstedt et al. | 175/426 |
| 2009/0301788 | A1 * | 12/2009 | Stevens et al. | 175/374 |
| 2010/0006345 | A1 | 1/2010 | Stevens | |
| 2010/0307838 | A1 | 12/2010 | Stevens et al. | |
| 2013/0206483 | A1 * | 8/2013 | Johnson et al. | 175/425 |

OTHER PUBLICATIONS

Copenheaver, Blaine R, International Search Report and Written Opinion of the International Searching Authority for PCT/US2012/059775, Jan. 22, 2013, pp. 1-9.

Extended European Search Report dated Nov. 9, 2015 for app. # 12840584.2.

"Technopowders", Technogenia S.A. brochure, 2 pages, Saint-Jorioz, France.

* cited by examiner

USE OF TUNGSTEN CARBIDE TUBE ROD TO HARD-FACE PDC MATRIX

CROSS REFERENCE TO RELATED APPLICATIONS

This patent application claims priority under 35 U.S.C. §119 to U.S. Provisional Patent Application No. 61/547,328, entitled "Use Of Tungsten Carbide Tube Rod To Hard-Face PDC Matrix" filed on Oct. 14, 2011, the entire content of which is hereby incorporated by reference herein.

BACKGROUND

This invention relates generally to infiltrated matrix drilling products including, but not limited to, matrix drill bits, bi-center bits, core heads, and matrix bodied reamers and stabilizers. More particularly, this invention relates to hard-faced infiltrated matrix drilling products and the methods of hard-facing such items.

FIG. 1 shows a perspective view of an infiltrated matrix drill bit 100 in accordance with the prior art. Referring to FIG. 1, the infiltrated matrix drill bit 100, or drill bit, includes a bit body 110 that is coupled to a shank 115. The shank 115 includes a threaded connection 116 at one end 120. The threaded connection 116 couples to a drill string (not shown) or some other equipment that is coupled to the drill string. The threaded connection 116 is shown to be positioned on the exterior surface of the one end 120. This positioning assumes that the infiltrated matrix drill bit 100 is coupled to a corresponding threaded connection located on the interior surface of a drill string (not shown). However, the threaded connection 116 at the one end 120 is alternatively positioned on the interior surface of the one end 120 if the corresponding threaded connection of the drill string (not shown) is positioned on its exterior surface in other exemplary embodiments. A bore (not shown) is formed longitudinally through the shank 115 and the bit body 110 for communicating drilling fluid from within the drill string to a drill bit face 111 via one or more nozzles 114 during drilling operations.

The bit body 110 includes a plurality of blades 130 extending from the drill bit face 111 of the bit body 110 towards the threaded connection 116. The drill bit face 111 is positioned at one end of the bit body 110 furthest away from the shank 115. The plurality of blades 130 form the cutting surface of the infiltrated matrix drill bit 100. One or more of these plurality of blades 130 are either coupled to the bit body 110 or are integrally formed with the bit body 110. A junk slot 122 is formed between each consecutive blade 130, which allows for cuttings and drilling fluid to return to the surface of the wellbore (not shown) once the drilling fluid is discharged from the nozzles 114. A plurality of cutters 140 are coupled to each of the blades 130 and extend outwardly from the surface of the blades 130 to cut through earth formations when the infiltrated matrix drill bit 100 is rotated during drilling. The cutters 140 and portions of the bit body 110 deform the earth formation by scraping and/or shearing. The cutters 140 and portions of the bit body 110 are subjected to extreme forces and stresses during drilling which causes surface of the cutters 140 and the bit body 110 to wear. Eventually, the surfaces of the cutters 140 and the bit body 110 wear to an extent that the infiltrated matrix drill bit 100 is no longer useful for drilling and is either repaired for subsequent use or is disposed and replaced by another drill bit. Although one embodiment of the infiltrated drill bit has been described, other infiltrated drill bit embodiments known to people having ordinary skill in the art are applicable to exemplary embodiments of the present invention.

FIG. 2 shows a cross-sectional view of a down hole tool casting assembly 200 used in fabricating the infiltrated matrix drill bit 100 (FIG. 1) in accordance with the prior art. Referring to FIG. 2, the down hole tool casting assembly 200 consists of a mold 210, a stalk 220, one or more nozzle displacements 222, a blank 224, a funnel 240, and a binder pot 250. The down hole tool casting assembly 200 is used to fabricate a casting (not shown) of the infiltrated matrix drill bit 100.

According to a typical casting apparatus and method as shown in FIG. 2, the mold 210 is fabricated with a precisely machined interior surface 212, and forms a mold volume 214 located within the interior of the mold 210. The interior surface 212 at least partially surrounds the mold volume 214. The mold 210 is made from sand, hard carbon graphite, or ceramic. The precisely machined interior surface 212 has a shape that is a negative of what will become the facial features of the eventual drill bit face 111 (FIG. 1). The precisely machined interior surface 212 is milled and dressed to form the proper contours of the finished infiltrated matrix drill bit 100 (FIG. 1). Various types of cutters 140 (FIG. 1), known to persons having ordinary skill in the art, can be placed along the locations of the cutting edges of the bit 100 (FIG. 1) and can also be optionally placed along the gauge area of the bit 100 (FIG. 1). These cutters 140 (FIG. 1) can be placed during the bit fabrication process within the mold 210 or after the bit 100 (FIG. 1) has been fabricated via brazing or other methods known to people having ordinary skill in the art.

Once the mold 210 is fabricated, displacements are placed at least partially within the mold volume 214. The displacements are typically fabricated from clay, sand, graphite, or ceramic. These displacements consist of the center stalk 220 and the at least one nozzle displacement 222. The center stalk 220 is positioned substantially within the center of the mold 210 and suspended a desired distance from the bottom of the mold's interior surface 212. The nozzle displacements 222 are positioned within the mold 210 and extend from the center stalk 220 to the bottom of the mold's interior surface 212, which is where the nozzle 114 (FIG. 1) is formed. The center stalk 220 and the nozzle displacements 222 are later removed from the eventual drill bit casting so that drilling fluid can flow though the center of the finished infiltrated matrix drill bit 100 (FIG. 1) during the drill bit's operation.

The blank 224 is a cylindrical steel casting mandrel that is centrally suspended at least partially within the mold 210 and around the center stalk 220. A tooling (not shown), which is known to people having ordinary skill in the art, is used to suspend the blank 224 within the mold 210. The blank 224 is hanged on the tooling and the tooling is lowered so that the blank 224 is positioned a predetermined distance down into the mold 210 and aligned appropriately therein as desired. An upper portion of the blank 224 forms the shank 115 (FIG. 1) after completion of the fabrication process.

Once the displacements 220, 222 and the blank 224 have been properly positioned within the mold 210, tungsten carbide powder 230 is loaded into the mold 210 so that it fills a portion of the mold volume 214 that includes an area around the lower portion of the blank 224, between the inner surfaces of the blank 224 and the outer surfaces of the center stalk 220, and between the nozzle displacements 222. Shoulder powder 234 is loaded on top of the tungsten carbide powder 230 in an area located at both the area outside of the blank 224 and the area between the blank 224 and the center stalk 220. The shoulder powder 234 can be made of tungsten powder. This shoulder powder 234 acts to blend the casting to the steel blank 224 during fabrication and is machinable. Once the tungsten carbide powder 230 and the shoulder powder 234 are loaded into the mold 210, the mold 210 is typically vibrated to improve the compaction of the tungsten carbide powder 230 and the shoulder powder 234. Although the mold 210 is vibrated after the tungsten carbide powder 230 and the shoulder powder 234 are loaded into the mold 210, the vibration of the mold 210 can be done as an intermediate step before the shoulder powder 234 is loaded on top of the tungsten carbide powder 230. Additionally, the vibration of the mold 210 can be done as an intermediate step before the shoulder powder 234 is loaded on top of the tungsten carbide powder 230 and after the shoulder powder 234 is loaded on top of the tungsten carbide powder 230.

The funnel 240 is a graphite cylinder that forms a funnel volume 244 therein. The funnel 240 is coupled to the top portion of the mold 210. A recess 242 is formed at the interior edge of the bottom portion of the funnel 240, which facilitates the funnel 240 coupling to the upper portion of the mold 210. Although one example has been provided for coupling the funnel 240 to the mold 210, other methods known to people having ordinary skill in the art can be used. Typically, the inside diameter of the mold 210 is similar to the inside diameter of the funnel 240 once the funnel 240 and the mold 210 are coupled together.

The binder pot 250 is a cylinder having a base 256 with an opening 258 located at the base 256, which extends through the base 256. The binder pot 250 also forms a binder pot volume 254 therein for holding a binder material 260. The binder pot 250 is coupled to the top portion of the funnel 240 via a recess 252 that is formed at the exterior edge of the bottom portion of the binder pot 250. This recess 252 facilitates the binder pot 250 coupling to the upper portion of the funnel 240. Although one example has been provided for coupling the binder pot 250 to the funnel 240, other methods known to people having ordinary skill in the art can be used. Once the down hole tool casting assembly 200 has been assembled, a predetermined amount of binder material 260, which is ascertainable by people having ordinary skill in the art, is loaded into the binder pot volume 254. The typical binder material 260 is a copper or copper alloy, but can be a different metal or metal alloy, such a nickel or nickel alloy.

The down hole tool casting assembly 200 is placed within a furnace (not shown). The binder material 260 melts and flows into the tungsten carbide powder 230 through the opening 258 of the binder pot 250. In the furnace, the molten binder material 260 infiltrates the tungsten carbide powder 230. During this process, a substantial amount of binder material 260 is used so that it also fills at least a substantial portion of the funnel volume 244 located above the shoulder powder 234. This excess binder material 260 in the funnel volume 244 supplies a downward force on the tungsten carbide powder 230 and the shoulder powder 234. Once the binder material 260 completely infiltrates the tungsten carbide powder 230, the down hole tool casting assembly 200 is pulled from the furnace and is controllably cooled. The mold 210 is broken away from the casting. The casting then undergoes finishing steps which are known to people having ordinary skill in the art, including the addition of the threaded connection 116 (FIG. 1) coupled to the top portion of the blank 224 and the removal of the binder material 260 that filled at least a substantial portion of the funnel volume 244. Although one method and apparatus has been described for fabricating the infiltrated matrix drill bit 100, other methods and/or apparatuses can be used for fabricating the infiltrated matrix drill bit 100 in other exemplary embodiments. Additionally, although exemplary materials have been mentioned for forming the components above, other suitable materials can be used. Further, although the binder material 260 melts and then is poured into the tungsten carbide powder 230, the binder material 260 can be either mixed with the tungsten carbide powder 230 or disposed above the tungsten carbide powder 230 prior to being melted.

Since drill bits are subjected to extreme forces and stresses during drilling which cause wear, manufacturers and/or users of drill bits and other downhole tools have attempted to reduce this wear by applying a hardfacing material directly on at least portions of the surface of the drill bit. The hardfacing material typically includes a first phase that exhibits relatively high hardness and a second phase that exhibits relatively high fracture toughness. The first phase is formed from tungsten carbide; however, other suitable materials can be used including, but not limited to, titanium carbide, tantalum carbide, titanium diboride, chromium carbides, titanium nitride, aluminum oxide, aluminum nitride, and silicon carbide. The second phase is a metal matrix material formed from cobalt or cobalt-based alloys; however, other suitable materials can be used including, but not limited to, iron-based alloys, nickel-based alloys, iron- and nickel-based alloys, cobalt- and nickel-based alloys, iron- and cobalt-based alloys, aluminum-based alloys, copper-based alloys, magnesium-based alloys, and titanium-based alloys. These hardfacing materials are typically brought to a high temperature so that the matrix material melts and bonds to the surface of the drill bit. However, these hardfacing materials do not successfully bond directly to the surface of the infiltrated matrix drill bit 100 because of the presence of the binder material 260 within the infiltrated matrix drill bit 100. Therefore, manufacturers and/or users of drill bits applied the hardfacing material directly onto the surface of a sintered matrix drill bit (not shown), which does not include the binder material 260 that is present within the infiltrated matrix drill bit 100, as described above. A sintered matrix drill bit is fabricated differently than the infiltrated matrix drill bit 100 and is known to people having ordinary skill in the art.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

This invention relates generally to down hole tools and methods for manufacturing such items. More particularly, this invention relates to infiltrated matrix drilling products including, but not limited to, matrix drill bits, bi-center bits, core heads, and matrix bodied reamers and stabilizers, and the methods of manufacturing such items. Although the description provided below is related to an infiltrated matrix drill bit, exemplary embodiments of the invention relate to any infiltrated matrix drilling product.

Figure 2:
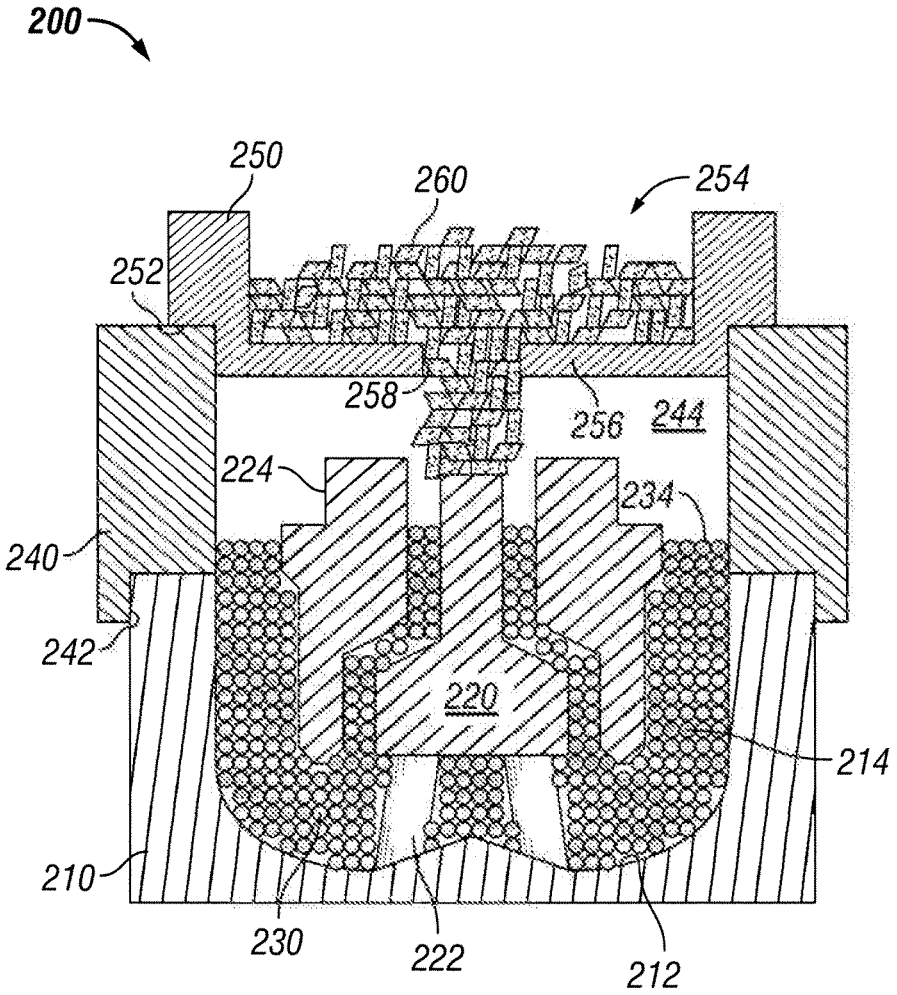
FIG. 2 (Prior Art)
FIG. 2 shows a cross-sectional view of a down hole tool casting assembly used in fabricating the infiltrated matrix drill bit of FIG. 1 in accordance with the prior art.
Figure 3:
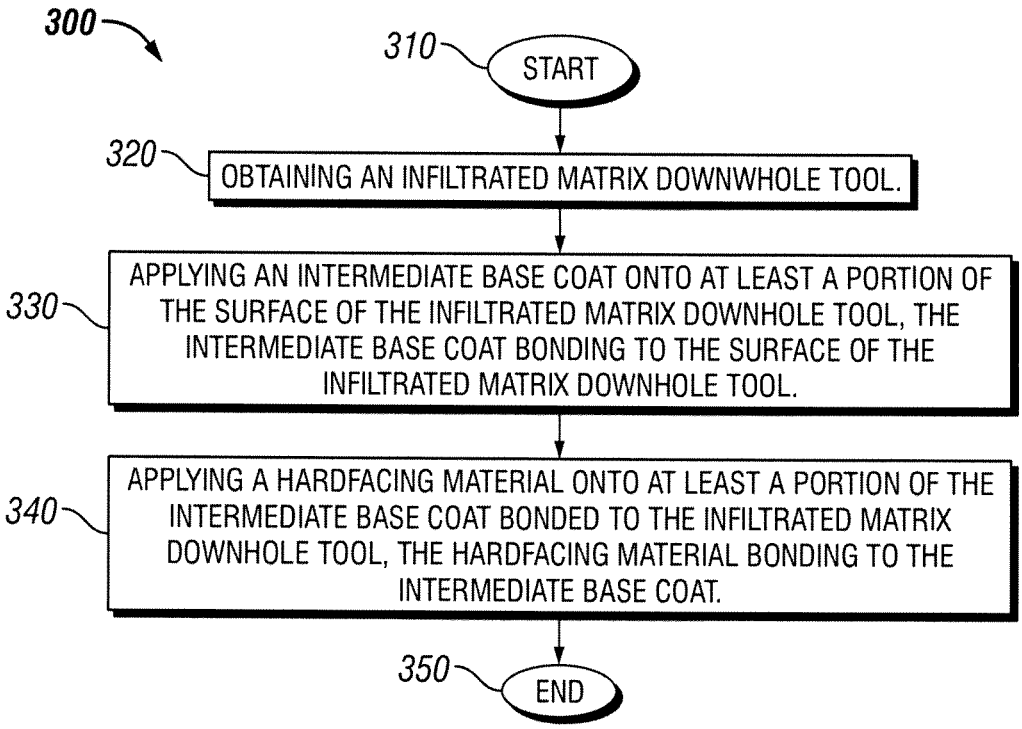
FIG. 3 illustrates a flowchart depicting a hardfacing method that applies a hardfacing material to an infiltrated matrix downhole tool in accordance with an exemplary embodiment.

FIG. 3 illustrates a flowchart depicting a hardfacing method 300 that applies a hardfacing material to an infiltrated matrix downhole tool 100 (FIG. 1) in accordance with an exemplary embodiment. The method 300 starts at step 310. Following step 310, an infiltrated matrix downhole tool is obtained at step 320. One example of the infiltrated matrix downhole tool is the infiltrated matrix drill bit 100 (FIG. 1), as described and illustrate with respect to FIGS. 1 and 2; however, the infiltrated matrix downhole tool is a different downhole tool type that is fabricated via infiltration of a binder material according to other exemplary embodiments. Since the infiltrated matrix drill bit 100 has been previously described in detail above, the description is not repeated for the sake of brevity.

Figure 1:
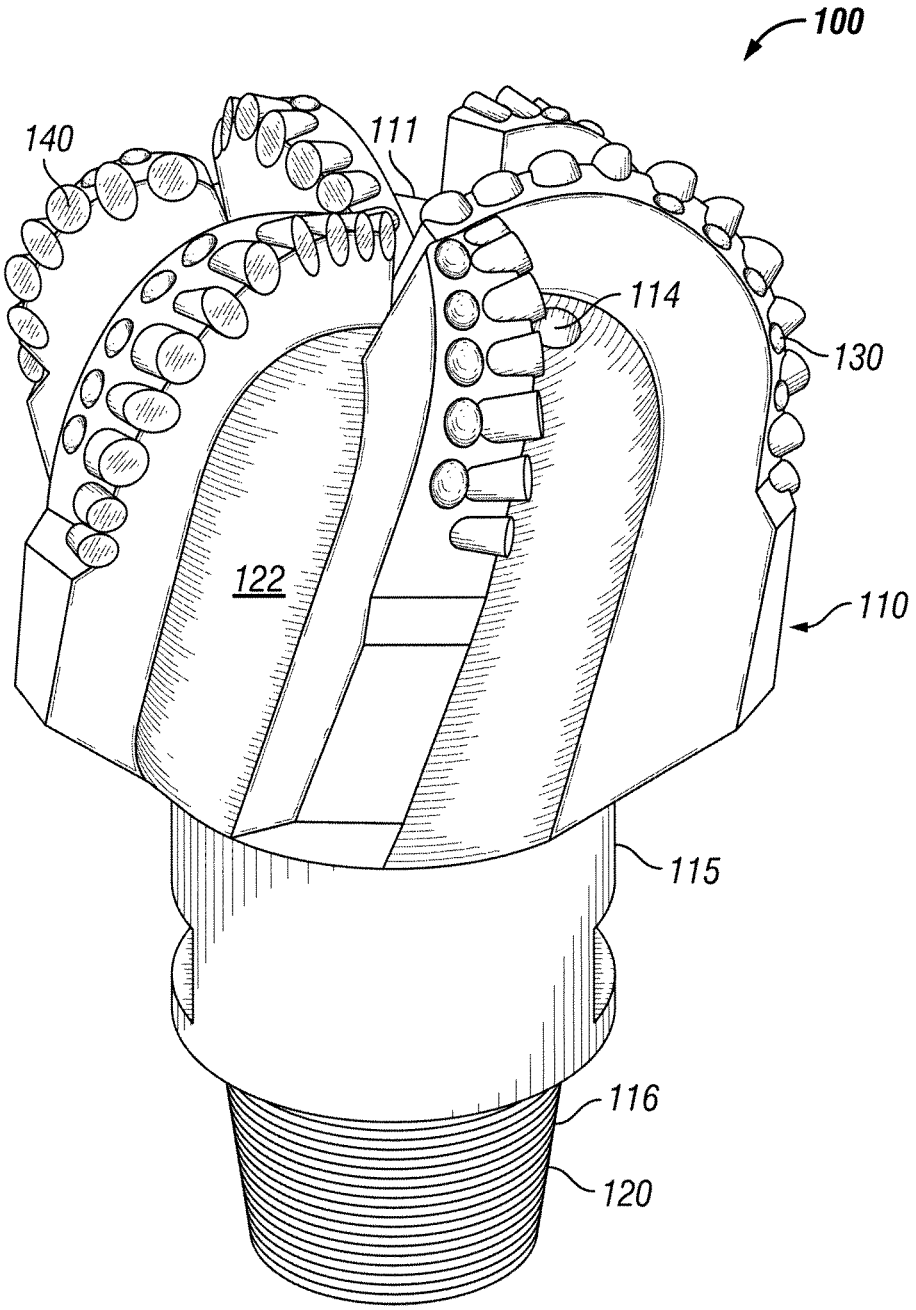
FIG. 1 (Prior Art)
FIG. 1 shows a perspective view of an infiltrated matrix drill bit in accordance with the prior art.

Referring to FIGS. 1 and 2, although the infiltrated matrix drill bit 100 has been previously described above, the fabrication and/or the structure of the infiltrated matrix drill bit 100 is different in other exemplary embodiments. For example, although the bit body 110 is fabricated using the binder material 260 infiltrating into the tungsten carbide powder 230, other suitable materials known to people having ordinary skill in the art is used in lieu of, or in addition to, the tungsten carbide powder 230. These suitable materials include, but are not limited to, other carbides of Group IV A, VA, or VIA metals, which are titanium, zirconium, halfnium, vanadium, niobium, tantalum, chromium, molybdenum, and tungsten. Additionally, although the binder material 260 has been previously described as being fabricated from copper, nickel, or alloys thereof, the binder material 260 is fabricated from another suitable metal that includes, but is not limited to, all transition metals, main group metals and alloys thereof. For example, copper, nickel, iron, and cobalt may be used as the major constituents in the binder material 260. Other elements, such as aluminum, manganese, chromium, zinc, tin, silicon, silver, boron, and lead, may also be present in the binder material 260.

Referring back to FIG. 3 and after step 320, an intermediate base coat is applied onto and bonded to at least a portion of the surface of the infiltrated matrix downhole tool at step 330, which is also referred to as an intermediate base coat application method 330. After step 330, a hardfacing material is applied onto and bonded to at least a portion of the intermediate base coat bonded to the infiltrated matrix downhole tool at step 340, which is also referred to as a hardfacing material application method 340. After step 340, the method 300 ends at step 350.

Figure 4:
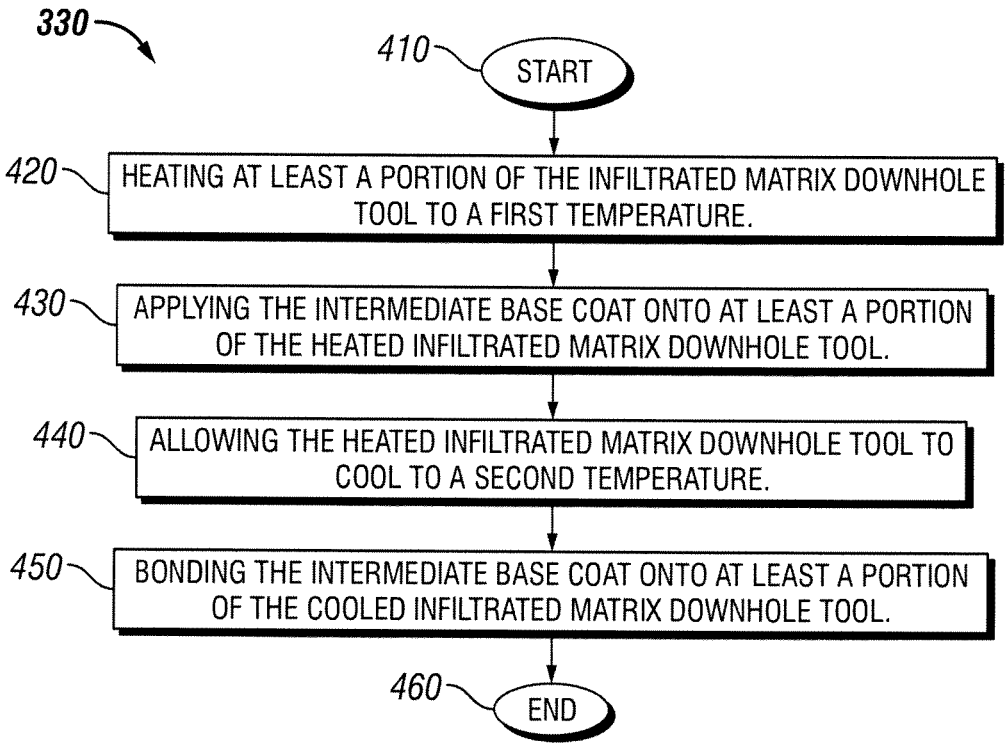
FIG. 4 illustrates a flowchart depicting an intermediate base coat application method that applies an intermediate base coat to the infiltrated matrix downhole tool in accordance with an exemplary embodiment.
Figure 5:
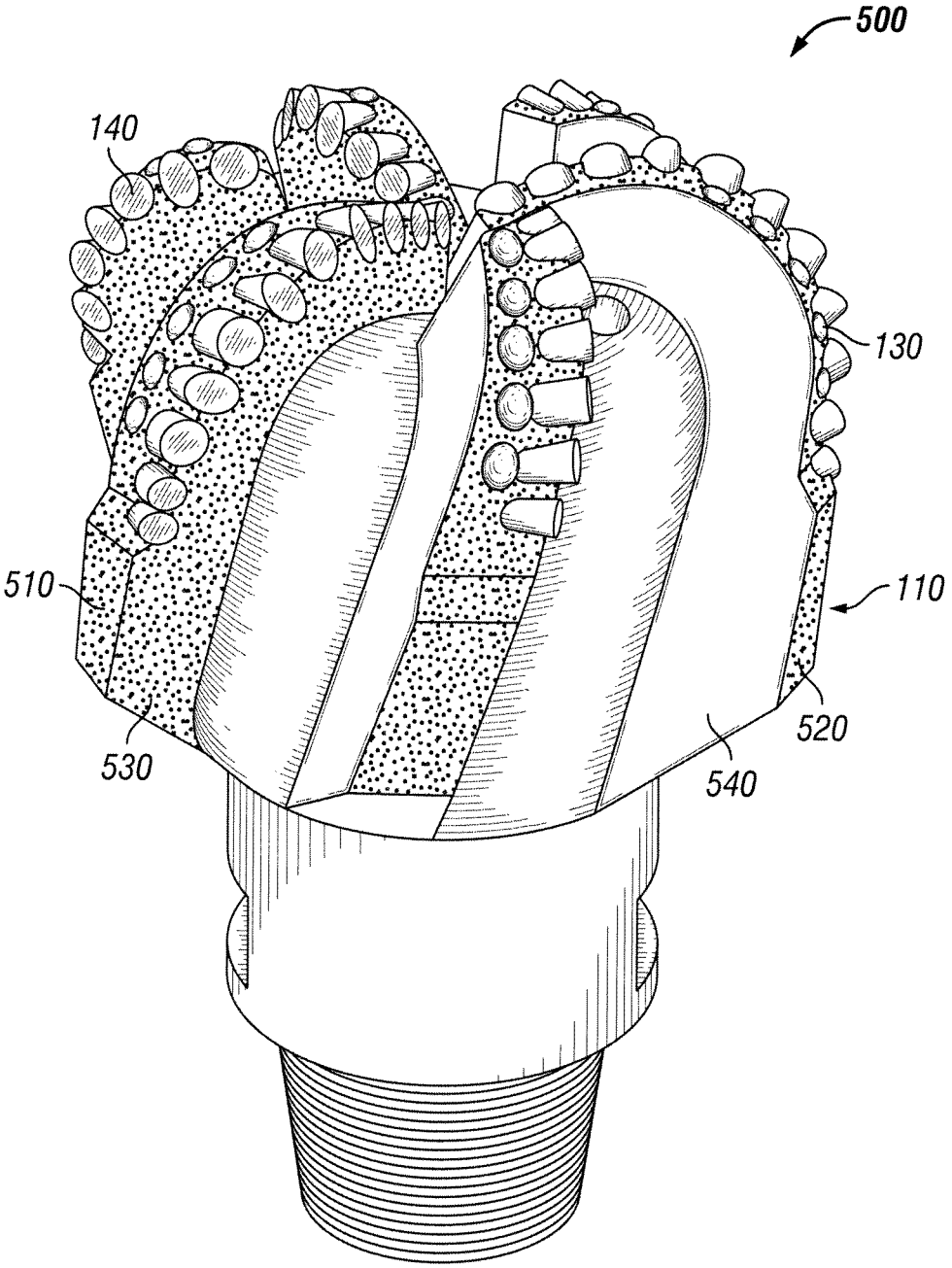
FIG. 5 shows a perspective view of an intermediately coated infiltrated matrix drill bit in accordance with an exemplary embodiment.

FIG. 4 illustrates a flowchart depicting the intermediate base coat application method 330 of FIG. 3 that applies an intermediate base coat to the infiltrated matrix downhole tool 100 (FIG. 1) in accordance with an exemplary embodiment. FIG. 5 shows a perspective view of an intermediately coated infiltrated matrix drill bit 500 in accordance with an exemplary embodiment. Referring to FIGS. 1, 4, and 5, the intermediate base coat application method 330 starts at step 410. Following step 410, at least a portion of the infiltrated matrix downhole tool 100 is heated to a first temperature. According to certain exemplary embodiments, the infiltrated matrix downhole tool 100 is placed in a furnace (not shown), or oven, and is heated to about 1000 degrees Fahrenheit or higher. However, according to other exemplary embodiments, the first temperature ranges from about 900 degrees Fahrenheit to about 1250 degrees Fahrenheit. Also, although an oven or furnace is used to heat the infiltrated matrix downhole tool 100, other heating devices are used to heat at least portions of the infiltrated matrix downhole tool 100. These portions of the infiltrated matrix downhole tool 100 that are to be heated includes at least portions of the bit body 110.

After step 420, the intermediate base coat 510 is applied onto at least a portion of the heated infiltrated matrix downhole tool at step 430. According to certain exemplary embodiments, the intermediate base coat 510 is a metal carbide powder that is applied onto portions of the heated infiltrated matrix downhole tool 100 using a flame spray torch (not shown). Although a flame spray torch is used to apply the intermediate base coat 510, other devices and/or methods are used to apply the intermediate base coat 510 without departing from the scope and spirit of the exemplary embodiment. One example of the intermediate base coat 510 is TPMB 40 Technopowder®, which is manufactured by Technogenia Inc. However, according to other exemplary embodiments, other suitable materials capable of bonding to both the surface of the infiltrated matrix downhole tool 100 and the hard facing material, described in further detail below, is used without departing from the scope and spirit of the exemplary embodiment. In some exemplary embodiments, the intermediate base coat 510 is applied onto at least portions of the blades 130 that include the face of the blade 130 and the area on the blades 130 between the cutters 140. Additionally, in certain exemplary embodiments, the intermediate base coat 510 also is applied onto other portions of the bit body 110 that exhibit erosion during drilling operations, such as the leading edge 530 of the blade 130.

After step 430, the heated infiltrated matrix downhole tool 100 is allowed to cool to a second temperature at step 440. According to some exemplary embodiments, the heated infiltrated matrix downhole tool 100 is cooled to the second temperature during application of the intermediate base coat 510 onto the surface of at least portions of the heated infiltrated matrix downhole tool 100. The second temperature is about 600 degrees Fahrenheit according to some exemplary embodiment; however, the second temperature ranges from about 400 degrees Fahrenheit to about 600 degrees Fahrenheit. According to alternative exemplary embodiments, the heated infiltrated matrix downhole tool 100 is allowed to cool to ambient temperature after the intermediate base coat 510 has been applied onto the surface of at least portions of the heated infiltrated matrix downhole tool 100 and subsequently heated back up to about 400 degrees Fahrenheit to about 600 degrees Fahrenheit.

After step 440, the intermediate base coat 510 is bonded to at least a portion of the cooled infiltrated matrix downhole tool 100 at step 450. Once the intermediate base coat 510 is bonded to the infiltrated matrix downhole tool 100, the intermediately coated infiltrated matrix drill bit 500 is formed. As seen in FIG. 5, the intermediately coated infiltrated matrix drill bit 500 is similar to the infiltrated matrix drill bit 100, except the intermediate base coat 510 is bonded to at least portions of the bit body 110. Specifically, the intermediate base coat 510 is bonded to the face 520 of each blade 130. The face 520 extends from one end of a leading edge 530 of the blade 130 to one end of a trailing edge 540 of the blade 130. Additionally, the intermediate base coat 510 also is bonded to the leading edge 530 of each blade 130 according to certain exemplary embodiments. In other exemplary embodiments, the intermediate base coat 510 is bonded to different portions of the bit body 110 without departing from the scope and spirit of the exemplary embodiment. After step 450, the intermediate base coat application method 330 ends at step 460.

The intermediate base coat 510 prevents or reduces the formation of oxides at the surface of the base metal, or surface of the drill bit 500 according to certain exemplary embodiments. In certain exemplary embodiments, the intermediate base coat 510 prevents or reduces the migration of chromium to the surface, which may result in sticking. Further, the intermediate base coat 510 facilitates the deposition of hardfacing material according to certain exemplary embodiments. Moreover, in some exemplary embodiments, the intermediate base coat 510 provides higher thickness accuracy.

The intermediate base coat 510 is composed primarily of four elements, including nickel, chrome, silicon, and boron, according to certain exemplary embodiments. Also, additional components are included along with these four elements in certain exemplary embodiments. Silicon and boron are reducing agents, meaning that they reduce oxides of nickel, cobalt, chrome and iron. Further, the intermediate base coat 510, with the silicon and boron additions, is said to be "self fluxing." With the reduction of oxides, it is possible to better control surface tension and fluidity. To a welder, or hardfacer, this means that it is easier to lay down a hardfacing material because the hardfacing material will easily wet the oxide free base metal. Therefore, instead of balling up, the metal lays down and easily wets the surface. Hence, it is said to"lay down smoothly." The hardfacing material 710 (FIG. 7A), as further described below, then forms a metallurgical bond with the intermediate base coat 510.

Figure 6:
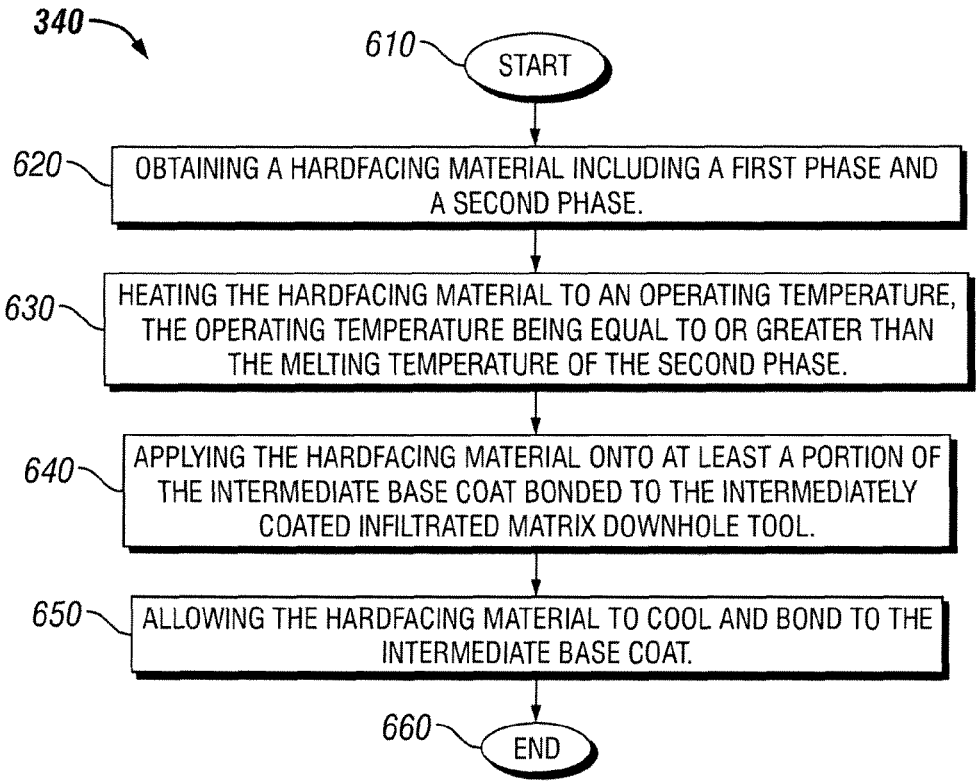
FIG. 6 illustrates a flowchart depicting a hardfacing material application method that applies a hardfacing material onto the intermediate base coat of the intermediately coated infiltrated matrix downhole tool in accordance with an exemplary embodiment.
Figure 7A:
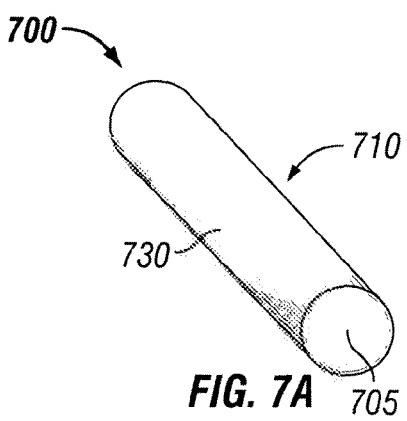
FIG. 7A is a perspective view of a tube rod including the hardfacing material in accordance with an exemplary embodiment.
Figure 7B:
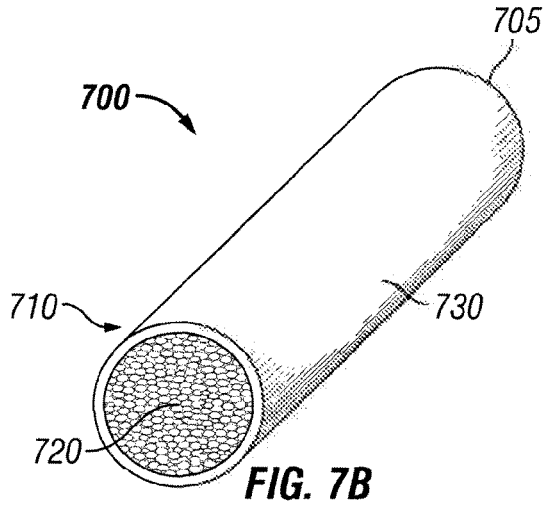
FIG. 7B is another perspective view of the tube rod of FIG. 7A in accordance with an exemplary embodiment.

FIG. 6 illustrates a flowchart depicting the hardfacing material application method 340 of FIG. 3 that applies a hardfacing material onto the intermediate base coat 510 (FIG. 5) of the intermediately coated infiltrated matrix downhole tool 500 (FIG. 5) in accordance with an exemplary embodiment. Referring to FIG. 6, the hardfacing material application method 340 starts at step 610. Following step 610, a hardfacing material that includes a first phase and a second phase is obtained at step 620. FIGS. 7A and 7B are perspective views of a tube rod 700 including the hardfacing material 710 in accordance with an exemplary embodiment. Although a tube rod 700 is described and illustrated as one apparatus for applying the hardfacing material 710, other devices and/or methods, such as a cast rod, arc welding, and oxy-fuel gas welding, are used in other exemplary embodiments.

Referring to FIGS. 7A and 7B, the tube rod 700 is a cylindrically-shaped rod that is formed from the hardfacing material 710. The hardfacing material 710 includes the first phase 720 that exhibits relatively high hardness and the second phase 730 that exhibits relatively high fracture toughness. The first phase 720 is formed from tungsten carbide; however, other suitable materials can be used including, but not limited to, titanium carbide, tantalum carbide, titanium diboride, chromium carbides, titanium nitride, aluminum oxide, aluminum nitride, and silicon carbide. The second phase 730 is a metal matrix material formed from cobalt or cobalt-based alloys; however, other suitable materials can be used including, but not limited to, iron-based alloys, nickel-based alloys, iron- and nickel-based alloys, cobalt- and nickel-based alloys, iron- and cobalt-based alloys, aluminum-based alloys, copper-based alloys, magnesium-based alloys, and titanium-based alloys. The second phase 730 forms a hollow, cylindrical portion of the tube rod 700, while the first phase 720 fills the hollowed portion and is surrounded by the second phase 730. In certain exemplary embodiments, at least one end 705 of the hollow, cylindrical tube rod 700 is sealed using the second phase 730. According to some exemplary embodiments, the tube rod 700 is a Kennametal 5500 rod, which is manufactured by Kennametal, Inc.; however, other tube rods can be used in other exemplary embodiments.

Referring to FIGS. 6, 7A, and 7B, after step 620, the hardfacing material 710 is heated to an operating temperature which is equal to or greater than the melting temperature of the second phase 730 at step 630. According to some exemplary embodiments, the end 705 of the tube rod 700 is heated using a flame torch (not shown) or some other known heating device or method, some of which have been mentioned above. The flame torch heats the hardfacing material 710 to the operating temperature causing the second phase 730 to melt. According to some exemplary embodiments, the operating temperature ranges from about 500 degrees Fahrenheit to about 600 degrees Fahrenheit. However, in other exemplary embodiments, the operating temperature ranges from about 400 degrees Fahrenheit to about 600 degrees Fahrenheit depending upon the hardfacing material 710 used. In some exemplary embodiments, the intermediately coated infiltrated matrix downhole tool 500 is heated to about the operating temperature.

Figure 8:
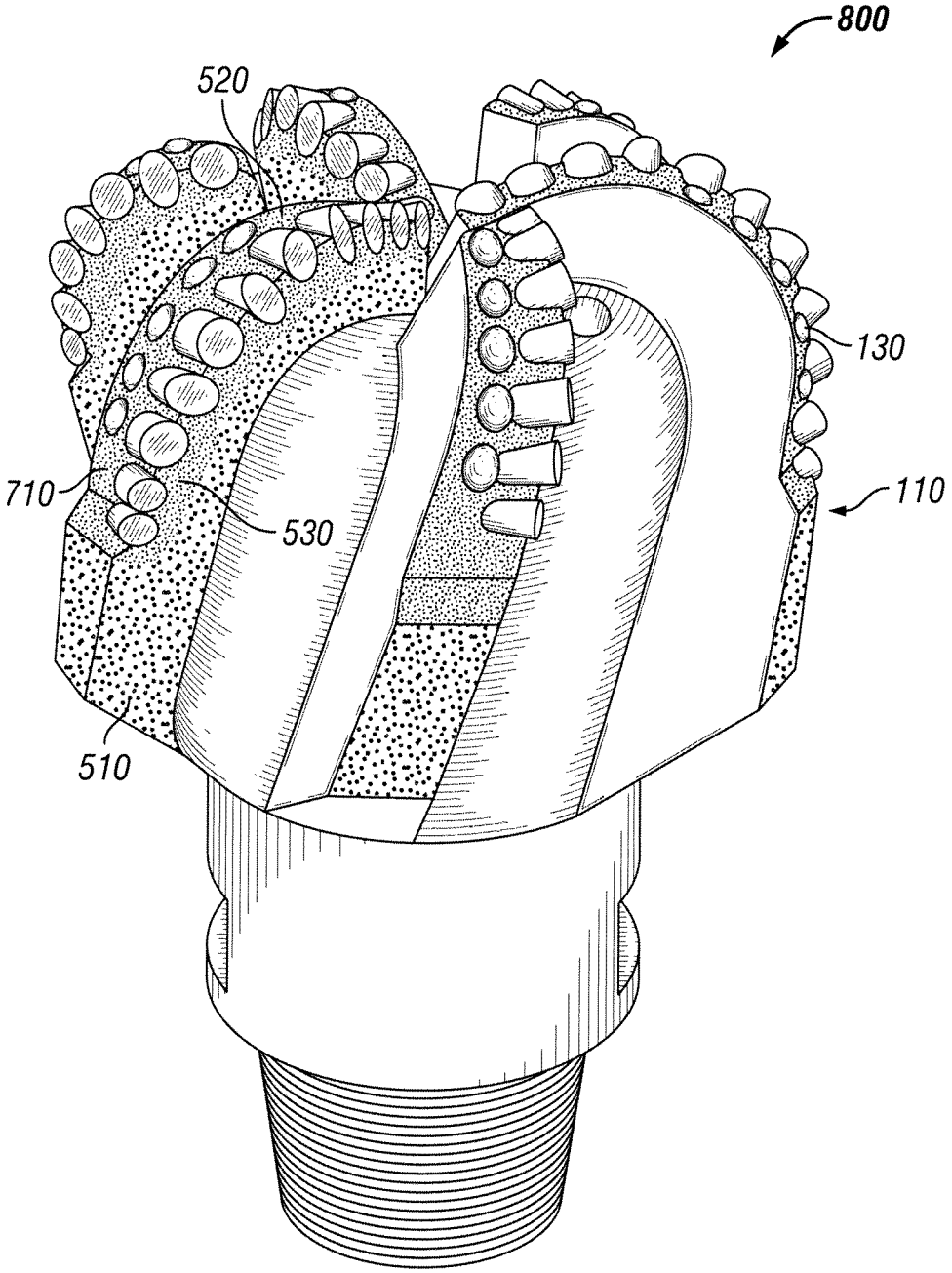
FIG. 8 shows a perspective view of a hardfaced infiltrated matrix drill in accordance with an exemplary embodiment.

After step 630, the hardfacing material 710 is applied onto at least a portion of the intermediate base coat 510 bonded to the intermediately coated infiltrated matrix drill bit 500 (FIG. 5) at step 640. FIG. 8 shows a perspective view of a hardfaced infiltrated matrix drill 800 in accordance with an exemplary embodiment. Referring to FIGS. 6, 7A, 7B, and 8, the end 705 of the heated tube rod 700 is brought into contact with the intermediate base coat 510 and is allowed to be melted onto at least portions of the intermediate base coat 510. In some exemplary embodiments, the sealed end 705 is melted or welded onto at least a portion of the intermediate base coat 510. As the tube 700 melts, the first phase 720, or tungsten carbide particles in some examples, within the hollow, cylindrical tube 700 mix with and are suspended in the molten second phase 730, or molten matrix material, as it is deposited onto the intermediately coated infiltrated matrix downhole tool 500 (FIG. 5). According to some exemplary embodiments, a number four torch tip is used for melting the tube 700, but other devices and methods known to people having ordinary skill in the art is used to melt the tube 700 in other exemplary embodiments.

After step 640, the hardfacing material is allowed to cool and bond to the intermediate base coat at step 650. As seen in FIG. 8, the hard faced infiltrated matrix drill bit 800 is similar to the intermediately coated infiltrated matrix drill bit 500 (FIG. 5), except the hardfacing material 710 is bonded to at least portions of the intermediate base coat 510. Specifically, the hardfacing material 710 is bonded to the face 520 of each blade 130. Additionally, the hardfacing material 710 also is bonded to at least portions of the leading edge 530 of each blade 130 according to certain exemplary embodiments. In other exemplary embodiments, the hardfacing material 710 is bonded to different portions of the bit body 110 without departing from the scope and spirit of the exemplary embodiment. After step 650, the hardfacing material application method 340 ends at step 660.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

I claim:

1. A hardfaced infiltrated matrix downhole tool, comprising:

a body comprising a carbide material and an infiltrating binder material of copper or copper alloy;

a blade formed integrally with the body, made from the same materials as the body, and extending from about one end of the body towards a second end of the body, the blade comprising a leading edge, a trailing edge, and a face extending from the leading edge to the trailing edge;

at least one cutter mounted on the face;

an intermediate base coat coupled to at least a portion of at least one of the leading edge and the face and being a nickel-chromium alloy including one or more reducing agents; and a hardfacing material coupled to at least a portion of the intermediate base coat, wherein the intermediate base coat bonds to the blade and the hardfacing material.

2. The hardfaced infiltrated matrix downhole tool of claim 1, wherein the body forms at least a portion of an infiltrated matrix drill bit.

3. The hardfaced infiltrated matrix downhole tool of claim 1, wherein the carbide material is formed using one or more metals selected from a group consisting of titanium, zirconium, halfnium, vanadium, niobium, tantalum, chromium, molybdenum, and tungsten.

4. The hardfaced infiltrated matrix downhole tool of claim 1, wherein the intermediate base coat is coupled to the face.

5. The hardfaced infiltrated matrix downhole tool of claim 1, wherein the intermediate base coat is coupled to the leading edge.

6. The hardfaced infiltrated matrix downhole tool of claim 1, wherein the reducing agents comprise silicon and boron.

7. The hardfaced infiltrated matrix downhole tool of claim 1, wherein the hardfacing material comprises a first phase that exhibits hardness and a second phase that exhibits fracture toughness.

8. The hardfaced infiltrated matrix downhole tool of claim 7, wherein the first phase comprises at least one of tungsten carbide, titanium carbide, tantalum carbide, titanium diboride, chromium carbide, titanium nitride, aluminum nitride, aluminum oxide, and silicon carbide.

9. The hardfaced infiltrated matrix downhole tool of claim 8, wherein the second phase comprises at least one of cobalt, iron, nickel, aluminum, copper, magnesium, titanium, and one or more alloys thereof.

10. A hardfaced infiltrated matrix drill bit, comprising:

a bit body fabricated from at least a carbide material and an infiltrating binder material of copper or copper alloy facilitating the bonding of the carbide material;

a shank coupled to the bit body;

a blade formed integrally with the bit body, made from the same materials as the body, and extending from about one end of the bit body towards the shank, the blade comprising a leading edge, a trailing edge, and a face extending from the leading edge to the trailing edge;

at least one cutter mounted on the face;

an intermediate base coat bonded to at least a portion of at least one of the leading edge and the face and being a nickel-chromium alloy including one or more reducing agents; and a hardfacing material bonded to at least a portion of the intermediate base coat, wherein the intermediate base coat bonds to the blade and the hardfacing material.

11. The hardfaced infiltrated matrix drill bit of claim 10, wherein the intermediate base coat is coupled to the face.

12. The hardfaced infiltrated matrix drill bit of claim 10, wherein the intermediate base coat is self fluxing.

13. The hardfaced infiltrated matrix drill bit of claim 10, wherein the reducing agents comprise silicon and boron.

14. The hardfaced infiltrated matrix drill bit of claim 10, wherein the hardfacing material comprises a first phase that exhibits hardness and a second phase that exhibits fracture toughness.

15. The hardfaced infiltrated matrix drill bit of claim 14, wherein the first phase comprises tungsten carbide.

16. The hardfaced infiltrated matrix drill bit of claim 14, wherein the second phase is formed using one or more materials selected from a group consisting of cobalt, cobalt-based alloys, iron-based alloys, magnesium-based alloys, and titanium-based alloys.

17. The hardfaced infiltrated matrix drill bit of claim 10, wherein the hardfacing material is bonded directly to the intermediate base coat.

* * * * *